US005714736A

United States Patent [19]

Yoneda et al.

[11] Patent Number: 5,714,736

[45] Date of Patent: Feb. 3, 1998

[54] HEATING SYSTEM AND IMAGE FORMING APPARATUS

[75] Inventors: Satoru Yoneda, Toyohashi; Hideji Hayashi, Okazaki; Kazuo Mohri, Toyokawa, all of Japan

[73] Assignee: Minolta Co., Ltd., Osaka, Japan

[21] Appl. No.: 747,516

[22] Filed: Nov. 12, 1996

[30] Foreign Application Priority Data

Nov. 13, 1995 [JP] Japan ..... 7-294317
Oct. 29, 1996 [JP] Japan ..... 8-286517

[51] Int. Cl.[6] ..... G03G 15/20

[52] U.S. Cl. ..... 219/216; 399/330

[58] Field of Search ..... 219/216, 469–471; 399/328–334; 432/60; 492/46

[56] References Cited

U.S. PATENT DOCUMENTS 4,565,439 1/1986 Reynolds ..... 399/329
4,582,416 4/1986 Karz et al. ..... 219/216
5,465,146 11/1995 Higashi et al. ..... 219/216
5,499,089 3/1996 Tsukamoto et al. ..... 219/216

FOREIGN PATENT DOCUMENTS 4-125640 4/1992 Japan .
5-333944 12/1993 Japan .
6-318001 11/1994 Japan .

*Primary Examiner*—Teresa J. Walberg
*Assistant Examiner*—J. Pelham
*Attorney, Agent, or Firm*—Burns, Doane, Swecker & Mathis, LLP

[57] ABSTRACT

A belt fixing system for fixing a toner image to a sheet includes an endless belt. This belt is rotatably supported by a plurality of supporting members, or rollers. Also, the belt is heated by a heater such as lamp and rotated around the supporting members by a drive member such as motor. When a toner fixing has finished, the heater is switched off and then after a predetermined time period the drive member is halted. Preferably, the time period is a time required for the belt to make two revolutions. This approach prevents the belt from being heated too much, which extends the durability of the belt.

15 Claims, 10 Drawing Sheets

START PRINTING
#11
MOTOR STARTED
#12
COLOR PRINT ?
NO
YES
#13
3RD EXPOSURE ?
NO
YES
#14
HEAT LAMP←ON
TEMPERATURE
CONTROL STARTED
#15
SENSOR OFF ?
NO
YES
#16
CONTINUOUS PRINTING ?
YES
NO
#17
HEAT LAMP←OFF
#18
TIMER COUNTING STARTED
#19
SINGLE PRINT ?
MULTIPLE
SINGLE
#20
T1 FINISHED ?
NO
YES
#21
T2 FINISHED ?
NO
YES
#22
MOTOR←OFF
FINISH PRINTING

HEATING SYSTEM AND IMAGE FORMING APPARATUS

FIELD OF THE INVENTION

The invention relates to a belt heating system for use in an electrophotographic image forming apparatus such as copier, printer, and facsimile. Further, the invention relates to an image forming apparatus including the belt heating system.

BACKGROUND OF THE INVENTION

JPA 6-318001 discloses a belt fixing device for use in an electrophotographic image forming apparatus such as copier and printer. The fixing device includes a plurality of supporting rollers, a walled endless fixing belt entrained around the supporting rollers, and a heater for heating the fixing belt. With this belt type fixing device, an unfixed toner image supported on a sheet is brought into contact with the heated fixing belt and then fixed to the sheet.

If, however, a substrate of the fixing belt is made of nickel, elevating the temperature of the fixing belt leads a crystallization of the nickel and then a reduction of its durability. Further, the nickel crystallizes rapidly as the temperature of the belt is increased. This is illustrated in FIG. 14 which shows a relationship between the temperature of the heated fixing belt and a total period of heating time required for bringing about a fracture of the belt due to the crystallization.

Also, when the belt is halted at the same time that the heater is switched off as shown in FIG. 15, a portion of the belt, adjacent the heater, is overheated by a residual heat thereof. This overheating, which is referred to as "overshooting" hereinafter, reduces a durability of the fixing belt dramatically.

SUMMARY OF THE INVENTION

Accordingly, the object of the invention is to prevent the overshooting of the fixing belt and then to permit the belt to be used for a long time.

To this end, a belt heating system of the invention includes an endless belt, supporting means mounted inside the belt for rotatably supporting the belt, drive means for rotating the belt, heating means for heating the belt, and control means for controlling the drive means so that the belt halts a predetermined time period after the heating means has stopped heating the belt.

Preferably, the predetermined time period is a time required for the fixing belt to make two revolutions.

An image forming apparatus of the invention incorporates such belt heating system and is capable of performing a single print mode for printing one sheet or a multiple print mode for continuously printing a plurality of sheets alternatively, and the control means changes the time period depending upon the print mode to be performed. Note that the time period for single print mode may be greater than that of multiple print mode.

With the instant invention, the additional rotation of the fixing belt prohibits the heating means to overheat any portion of the belt by its residual heat, thereby preventing the belt from crystallizing or deteriorating. Therefore, the fixing belt can be used for a long time.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

PREFERRED EMBODIMENT OF THE INVENTION

Figure 1:
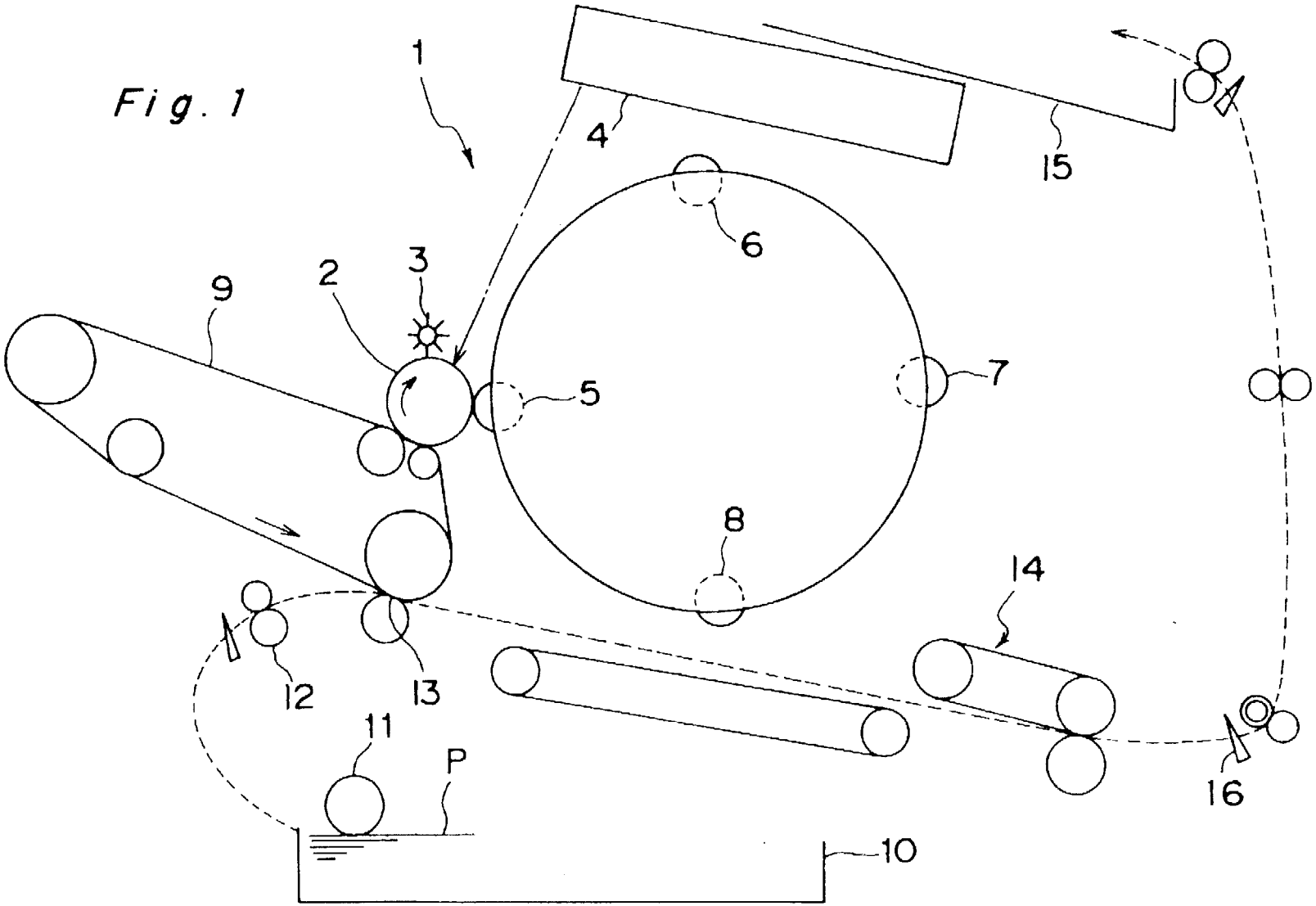
FIG. 1 is a side elevational view of an electrophotographic printer incorporating a fixing system.

With reference to the drawings, FIG. 1 shows a typical construction of an electrophotographic full-color printer 1 in which a fixing system of the invention is incorporated. With this printer 1, a photoconductive member, or photoconductive drum 2, is rotated in a direction indicated by the arrow. During the rotation, incremental portions of the outer periphery of the photoconductive drum 2 are electrically charged by a charger 3. The photoconductive drum 2 thus charged is then exposed by a laser light emitted from an exposure 4 to eventually form an electrostatic latent image therearound.

This electrostatic latent image is visualized into a yellow toner image at a developing station where a first developer 5 confronts the photoconductive drum 1. This image is then transferred onto a transfer belt 9 moving in a direction indicated by the arrow. Likewise, a second and a third electrostatic latent images are formed successively on the photoconductive drum 1 and then are visualized into magenta and cyan toner images by second and third developers 6 and 7, respectively. These toner images are then transferred successively onto the transfer belt 9 in superimposed registration with the first yellow toner image to form a multi-colored image.

A recording member, or sheet P, is fed from a sheet feeder 10 based upon rotations of a feed roller 11. This sheet is then transported into a transfer station 13 in synchronism with the toner images by a timing rollers 12, where the full-color toner image is transferred onto the sheet. This sheet is subsequently transported to a fixing system 14 of the invention where the toner images are melted and permanently fixed on the sheet. The resulting sheet having fixed toner images is finally discharged to a catch tray 15.

Note that, if a typical black and white image printing is requested, a fourth developer 8 accommodating a black toner is employed.

Figure 2:
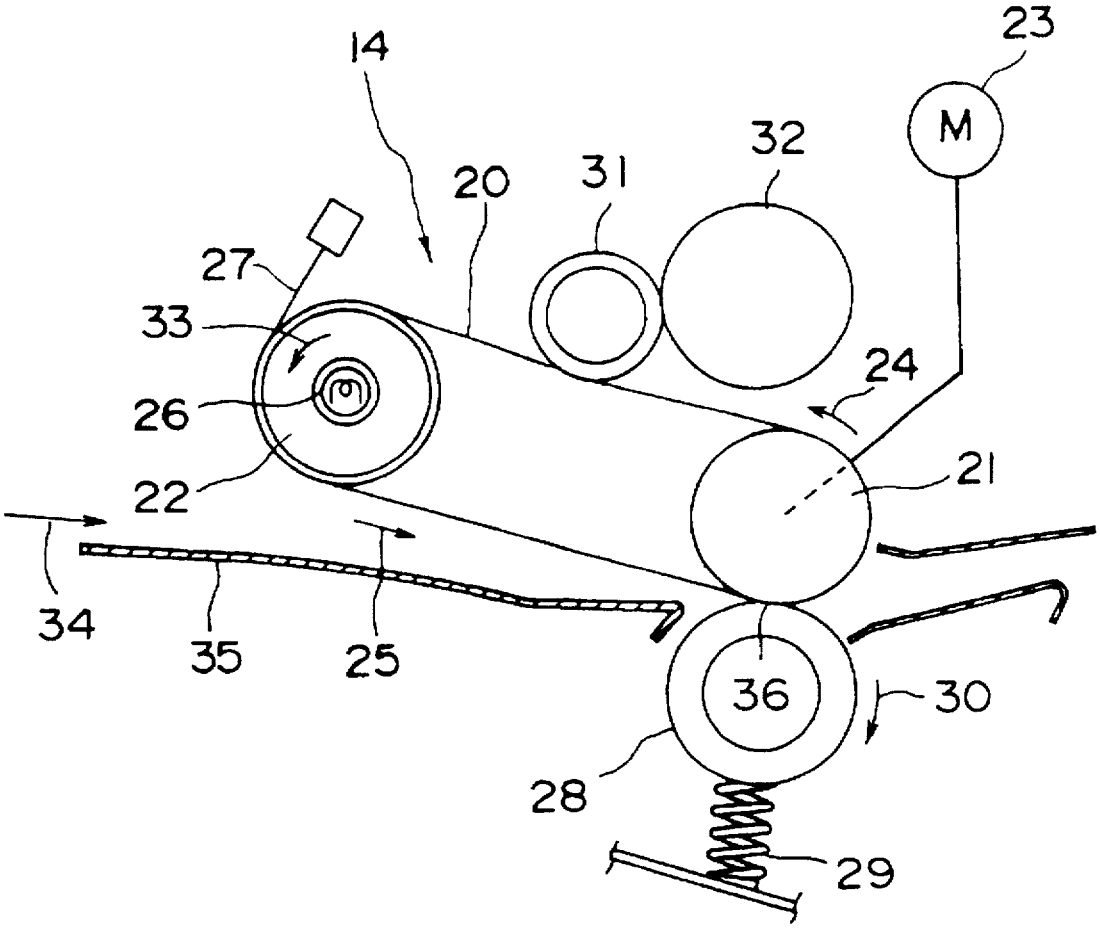
FIG. 2 is a side elevational view of the fixing system.

Referring to FIG. 2, the fixing system 14 includes an endless fixing belt 20. This belt 20, preferably a seamless belt, consists of, for example, a film made of carbon-steel, stainless steel, nickel, or heat resisting resin. Also, the belt 20 preferably has on its outer periphery a heat-resisting offset-preventing layer, made of for example a fluorine resin or a heat resisting rubber layer of for example a silicone rubber.

The belt 20 is entrained around a pair of supporting members, or a drive roller 21 and a heat roller 22. The drive roller 21 is drivingly connected with a motor 23 so that it can rotate in an arrow direction 24. Preferably, the drive roller 21 is covered on its outer periphery by a material having a high friction coefficient, e.g., silicon rubber so as to provide the belt 20 with a positive movement in the direction indicated by an arrow 25 without occurring any slip at contacting surfaces of the roller 21 and the belt 20.

The heat roller 22 on the other hand is preferably made of a material having a higher heat conductivity, e.g., aluminum or copper, so that it can transmit heat to the belt 20. To heat the belt 20, the roller 22 includes in its central portion a halogen lamp heater 26. This lamp 26 may be replaced by other types of heat generators such as electric resistance heater or electromagnetic induction heater. A thermal sensor 27 is disposed adjacent the heat roller 22 for detecting a temperature of a portion of the belt 20 contacting with the heat roller 22.

Further, a pressure roller 28 is arranged outside the belt 20. The pressure roller 28 is made from a metal tube, a metal rod, or a cylindrical member covered at its outer periphery with a coating layer of silicone rubber or fluoroethylene resin. Also, this roller 28 is forced by a biasing means such as spring 29 against a belt portion supported on the drive roller 21 to form a nipping region 36 therewith. Therefore, upon rotation of the drive roller 21 in the direction of arrow 24, the pressure roller 28 follows the movement of the belt 20 to rotate in the direction of arrow 30 due to friction generated between the roller 28 and belt 20.

The pressure roller 28 is preferably coated with a material capable of preventing the toner from adhering thereto. Typically, this material has a lower friction coefficient. As a result, when the sheet is nipped in the nipping region 36, the pressure roller 28 can slip against the belt 20 and the sheet and thereby possibly causes a transport failure of the sheet. To overcome this problem, preferably each of the rollers 21 and 28 and the belt 20 are enlarged in the transverse direction of the belt 20 so not confront the sheet to be transported. Further, end portions of the pressure roller 28 in the regions are preferably covered by a material having a higher friction coefficient, which ensures the roller 28 to follow the belt 20.

Furthermore, to extend the nipping region 36 between the pressure roller 28 and the belt 20, the outer surface of the roller 21 is preferably formed with a material having a lower hardness, e.g., sponge rubber.

An oil applying roller 31 is arranged above the belt 20 for applying an offset-preventing oil on the outer surface of the belt 20 so as to provide the belt 20 with a readily separation from the toner. This roller 31 is forced on the outer surface of a belt span travelling from the drive roller 21 towards the heat roller 22 so that the belt 20 is stretched properly. The oil applying roller 31 is in turn contact at its outer surface with a cleaning pad, cleaning roller, or oil supply roller 32. In place of the oil applying roller 31, the oil supply roller 32 may be brought into contact with the belt 20 directly for applying the oil therewith.

In operation, upon rotation of the motor 23, the drive roller 21 rotates in the direction of arrow 24. This causes the belt 20 to travel in the direction of arrow 25, which in turn rotates the heat roller 22 and pressure roller 28 in the directions of arrows 33 and 30, respectively. Incremental portions of the belt 20 moving past through a region where the belt 20 contacts with the heat roller 22, i.e., heating region, receive heat from the heat roller 22 heated by the heat lamp 26. The sheet and the unfixed toner image supported but not fixed on the sheet is transported along a guide 35 in a direction of arrow 34 towards the nipping region 36. While being transported on the guide 35, the sheet and the toner image are pre-heated by a heated belt span running from the heat roller 22 to the drive roller 21. The sheet supporting the toner image thereon is then advanced into the nipping region 36 where the toner image is melted by the heat of the belt 20. Also, the toner image is permanently fixed on the sheet by the pressure applied between the rollers 29 and 21. After the completion of the fixing, the heat lamp 26 is switched off and then after a predetermined delay time the motor 23 is switched off to halt the fixing belt 20.

Figure 3:
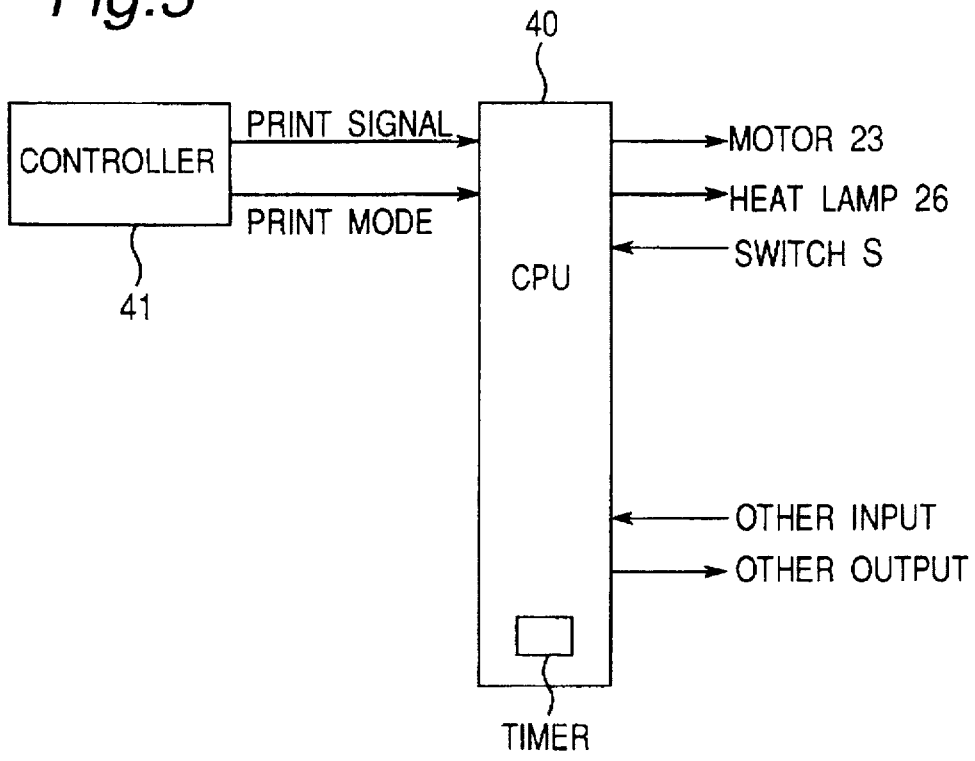
FIG. 3 is a circuit diagram including a controller and a central processing unit.
Figure 4:
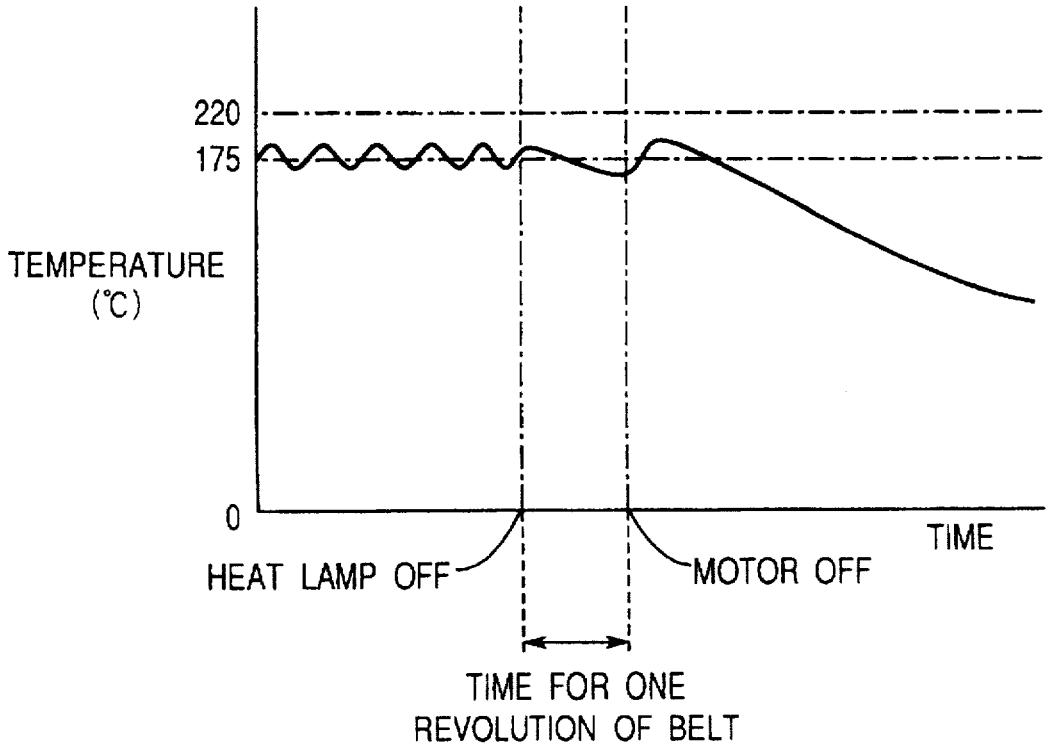
FIG. 4 is a graph which shows a temperature variation of a portion of a fixing belt that has heated by a heat roller when, after a heater has been switched off, a fixing belt made one revolution and then halted.

Discussions will be made to a process by which the motor 23 is halted a predetermined delay time after the heat lamp 26 has been switched off. This process is carried out by a central processing unit 40 shown in FIG. 3. The central processing unit 40 is electrically connected with a controller 41 which transmits thereto, among others, a signal for starting the printing and a signal of printing mode, i.e, a single print mode or a multiple print mode. Based upon those signals, the motor 23 and the heat lamp 26 are controlled.

Note that if, after switching off the heat lamp 26, the motor 23 is kept driving for a short time in which the fixing belt 20 makes one revolution and then brought to a stop, a temperature of a belt portion which keeps in contact with the heat roller 22 staying still is elevated again, which results in an overshooting of the belt.

Figure 5:
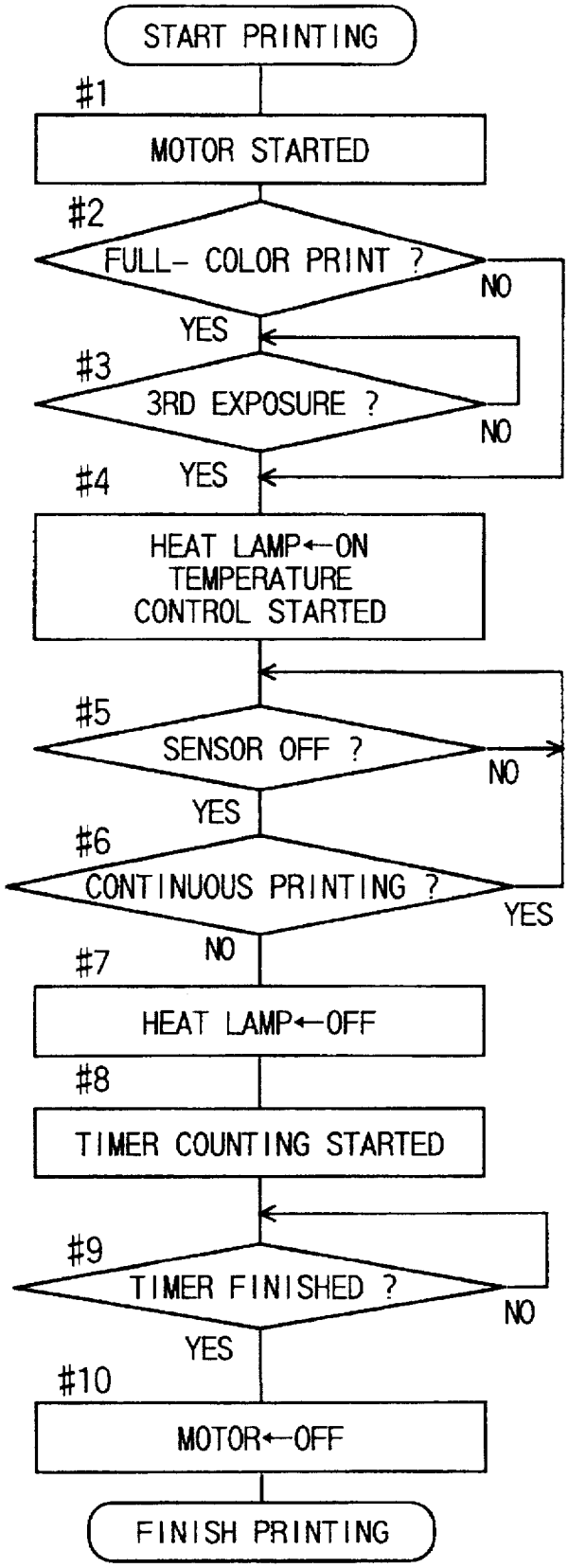
FIG. 5 is a flow-chart of a program for controlling the fixing system.

To overcome this problem, the temperature of the fixing belt is controlled according to a program shown in FIG. 5. With this program, after the start of printing, the motor 23 is driven at step #1. Then, a determination is made at step #2 whether the full-color print is instructed by the controller 41. If the full-color print is instructed, it is determined at step #3 whether the exposure for the third color image forming has started. If the full-color print is not instructed, the program jumps to step #4. At step #4, the heat lamp 26 is switched on and the temperature control for the heat belt 20 according to the signal fed from the thermal sensor 27 is started.

Next, a determination is made at step #5 whether the central processing unit 40 has detected an off-edge in a signal from a paper sensor 16 arranged on the downstream side of the nipping region 36 with respect to the moving direction of the sheet P, i.e., the sensor 16 has detected a tailing edge of the sheet P. If the off-edge is detected, a determination is made at step #6 whether the controller 41 has instructed the central processing unit 40 to make a plurality of prints continuously. If the continuous printing is instructed, the program repeats steps #5 and #6 to detect each tailing edge of the sheets to be fed out from the fixing system 14. If all the sheets, the number thereof being instructed to the central processing unit 40, has been detected by the sensor 16, the heat lamp 26 is switched off at step #7 and then a timer is started at step #8. After that, if it is determined at step #9 that the timer has finished, the motor 23 is halted, at step #10.

A period of time defined by the timer is a time in which the belt 20 can make two revolutions. This time period can be calculated by following equation:

$$\text{Time period}=2\cdot(L/V)$$

wherein L represents a circumferential length of the fixing belt, and V represents a circumferential speed of the photoconductive drum, or a system speed of the printer.

Figure 6:
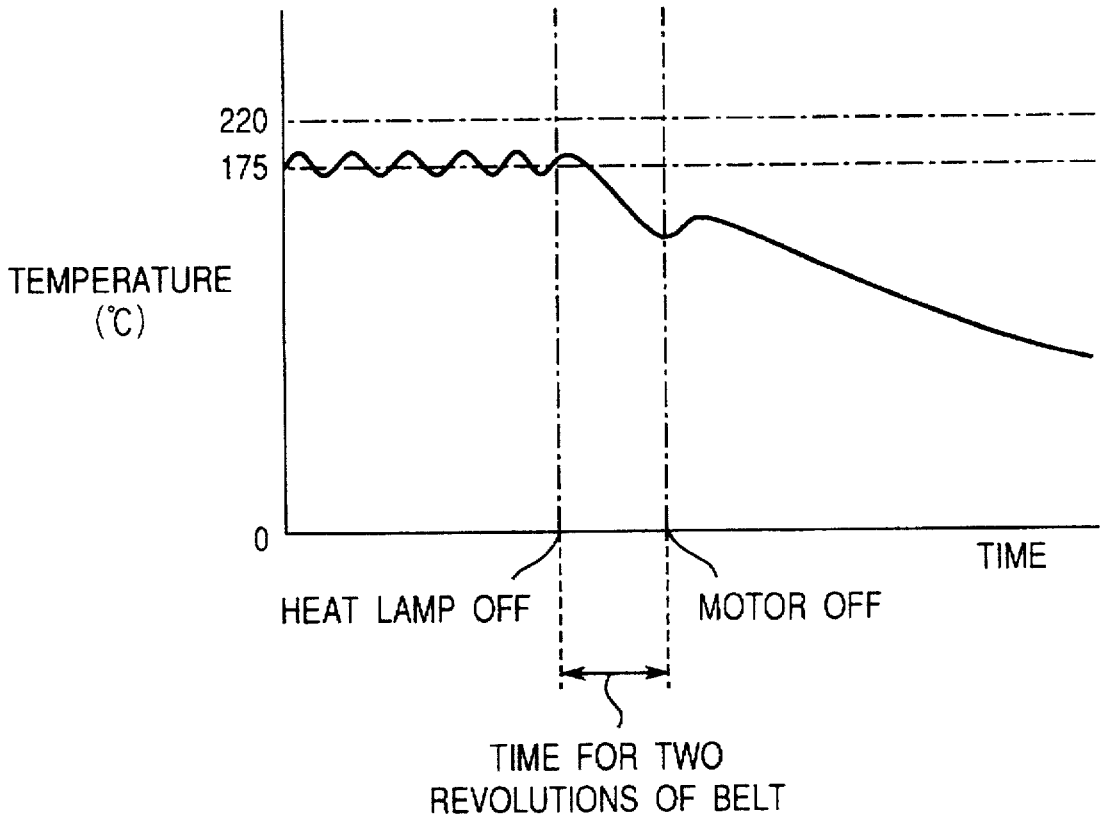
FIG. 6 is a graph which shows a temperature variation of the fixing belt in another case that, after the heater has been switched off, the fixing belt made two revolutions and then halted.

With this controlling program, as shown in FIG. 6, the fixing belt 20 is kept moving while the temperature of the heat roller 22 is rather high, and the belt 20 is halted after the temperature of the heat roller 22 has decreased down to a relatively low temperature. Therefore, the portion of the belt which keeps in contact with the halted heat roller is not heated too much, thereby preventing the fixing belt from deteriorating.

Figure 7:
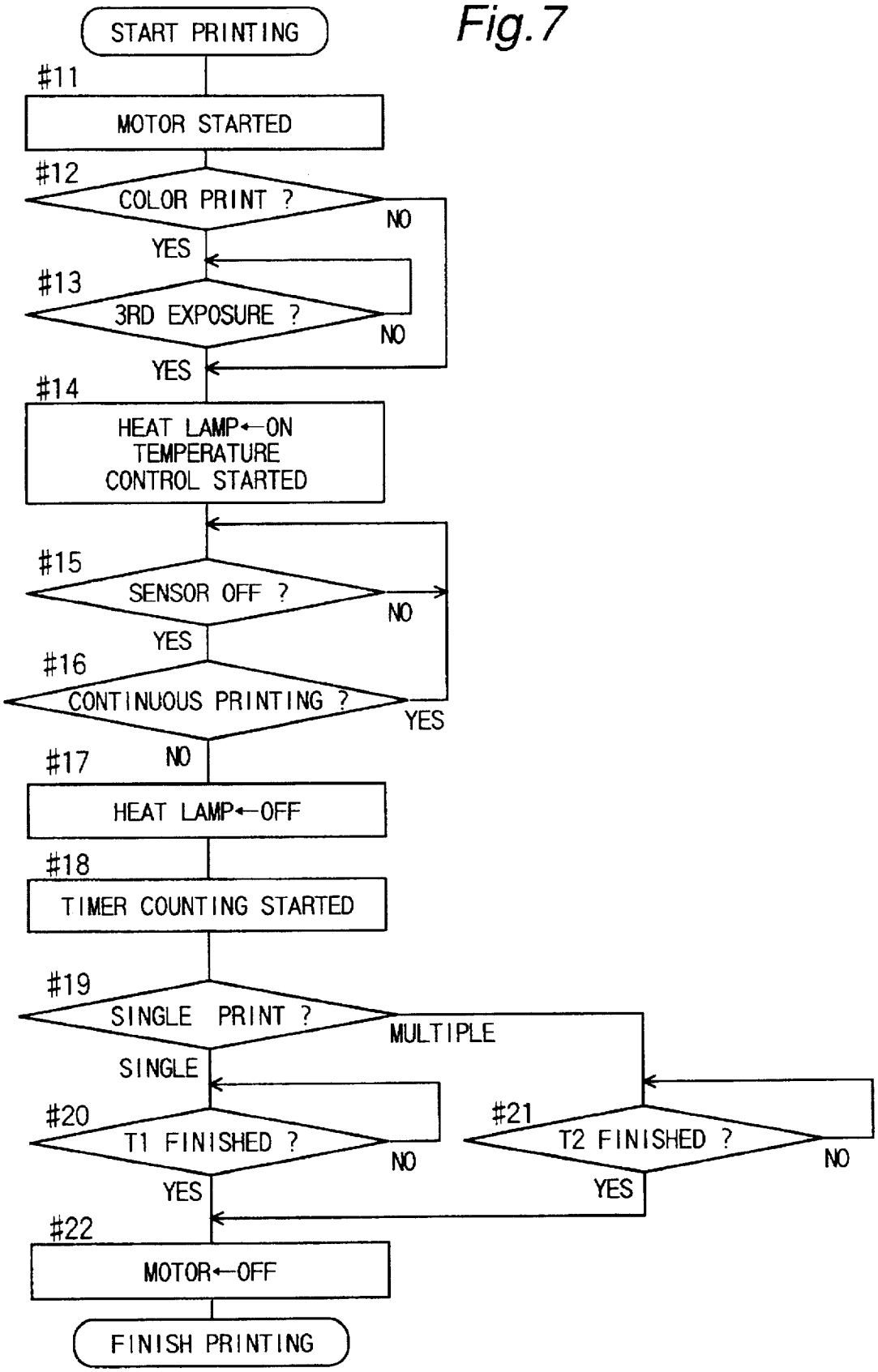
FIG. 7 is a flow-chart of another program for controlling the fixing system.

Referring to FIG. 7, a second embodiment of the invention will be described. In this embodiment, process steps from #11 to #17 are identical to those of from #1 to #7 in the previous embodiment, respectively, and therefore no discussion is made to these steps #11 to #17.

Subsequent to the step #17, a timer counting is started at step #18. Next, a determination is made at step #19 whether the single print for printing an image on one sheet has been instructed or multiple print for printing one or respective images on a plurality of sheets has been instructed. If the single print is instructed, it is determined at step #20 whether a period of time T1 defined by the timer has passed. If, however, the multiple print is instructed, it is determined at step #21 whether another period of time T2 defined by the timer has passed. When it is determined at step #20 or #21 that the timer has finished, the motor 23 is halted at step #22.

In the meantime, the portion of the belt that has been in contact with the sheet in the nipping region and thereby deprived of heat has a lower temperature. On the other hand, the portion of the belt that has not touched with the sheet, keeps a rather high temperature. Therefore, in case of multiple print, detecting temperature of the fixing belt 20 and controlling the heat lamp 26 based upon the detected temperature can result in the overheating of the belt 20, and the heat roller 22. Therefore, the time period T2 for multiple print is designed to be longer than the time period T1 for single print.

Figure 8:
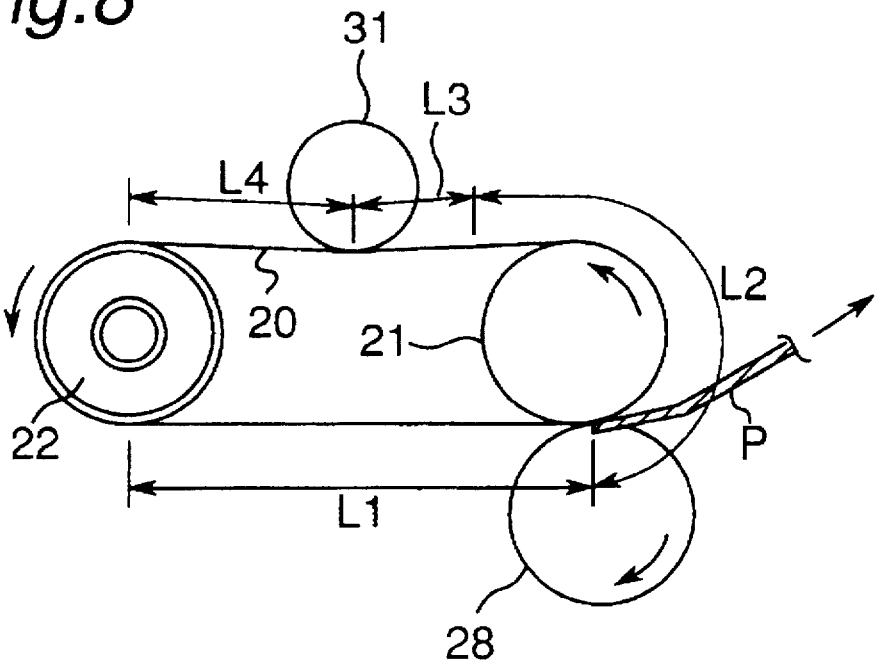
FIG. 8 is a side elevational view of the fixing system which shows portions of belt having different temperatures in a single print mode.

Referring to FIG. 8, the time period T1 for the single print will be described. Assuming that the tailing edge of the sheet P is in the nipping region 36. In this situation, a belt portion L1 extending from the heat roller 22 to the pressure roller 28 has an elevated temperature because it has heated by the contact with the heat roller 22. Another belt portion L2 has a lower temperature because it has touched with the sheet P and rollers 21 and 28 and thereby deprived of heat therefrom. Likewise, other portion L3 between the leading edge of the portion L2 and the oil-applying roller 31 has also a lower temperature because it has touched with the rollers 21 and 28 and thereby deprived of heat therefrom. Further, other portion L4 from the oil-applying roller 31 to the heat roller 22 has also a rather low temperature because it has touched with three rollers 21, 28, and 31.

Therefore, the time period T1 is determined to a time that the tailing edge of the belt portion L1 having the maximum temperature when the heat lamp 26 is switched off makes one revolution and then moves past at least the oil-applying roller 31. This allows the belt portion L1 to contact with the drive roller 21, pressure roller 28, and oil-applying roller 31 two times, respectively, and thereby reducing the temperature of the belt portion L1. Further, even if the belt portion L1 is rested still on the heat roller 22 and then re-heated by the residual heat of the heat roller 22, because the temperature thereof is already reduced, no crystallization or deterioration will be occurred in the belt.

Figure 9:
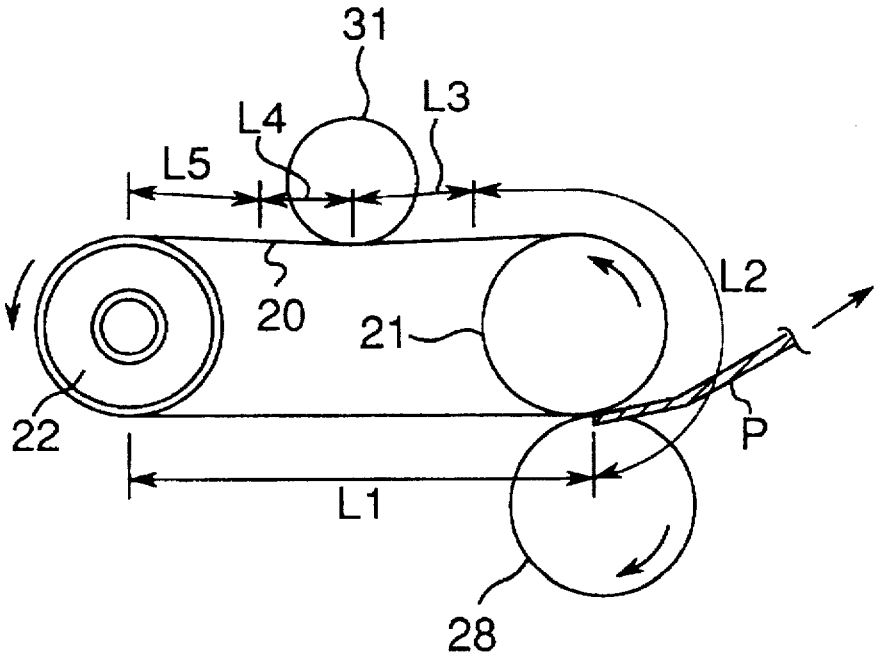
FIG. 9 is a side elevational view of the fixing system which shows portions of belt having different temperatures in a multiple print mode.

Referring to FIG. 9, the time period T2 for the multiple print will be described. Assuming that the tailing edge of the sheet P is in the nipping region 36. Note that the belt portion L2 is a portion where the sheet P has touched therewith while the belt portion L5 is a portion where another sheet previously fed has touched therewith. In this situation, the relationship of the temperatures of the belt portions L1 to L4 are similar to that of the corresponding portions described in FIG. 8. Also, the belt portion L5 has a lower temperature than the belt portion L4 because it is deprived of more heat due to the contact with the sheet. In the multiple print, however, a plurality of sheets P are fed to the fixing system 14 continuously and therefore the heat lamp 26 is hardly switched off during the printing. As a result, each temperature of the belt portions in the multiple printing is higher than that of corresponding belt portions in the single printing.

Therefore, the time period T2 is determined to a time that the tailing edge of the belt portion L1 having the maximum temperature when switching off the heat lamp 26 makes two revolutions and then moves past at least the oil-applying roller 31. This allows the belt portion L1 to contact with the drive roller 21, pressure roller 28, and oil-applying roller 31 three times, respectively, and thereby reducing the temperature of the belt portion L1. Further, even if the belt portion L1 is rested still on the heat roller 22 and then re-heated by the residual heat of the heat roller 22, since the temperature thereof is rather low, no crystallization or deterioration will be occurred in the belt.

Figure 10:
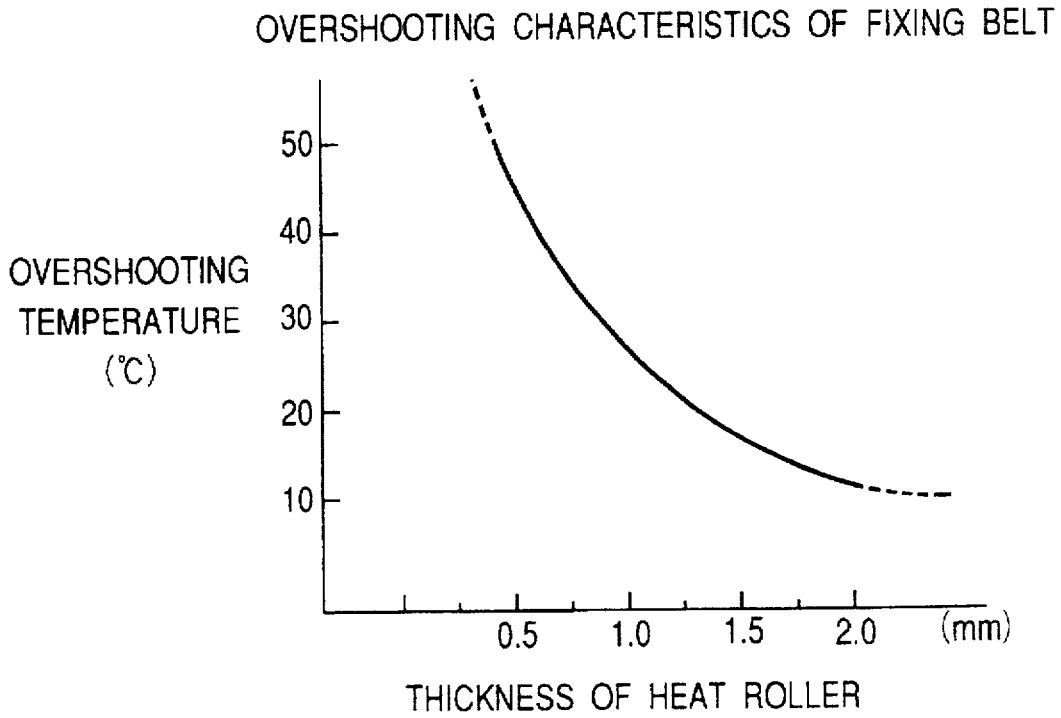
FIG. 10 is a graph which shows a relationship between a temperature rise of the fixing belt due to an overshooting belt and a thickness of the heating roller.
Figure 11:
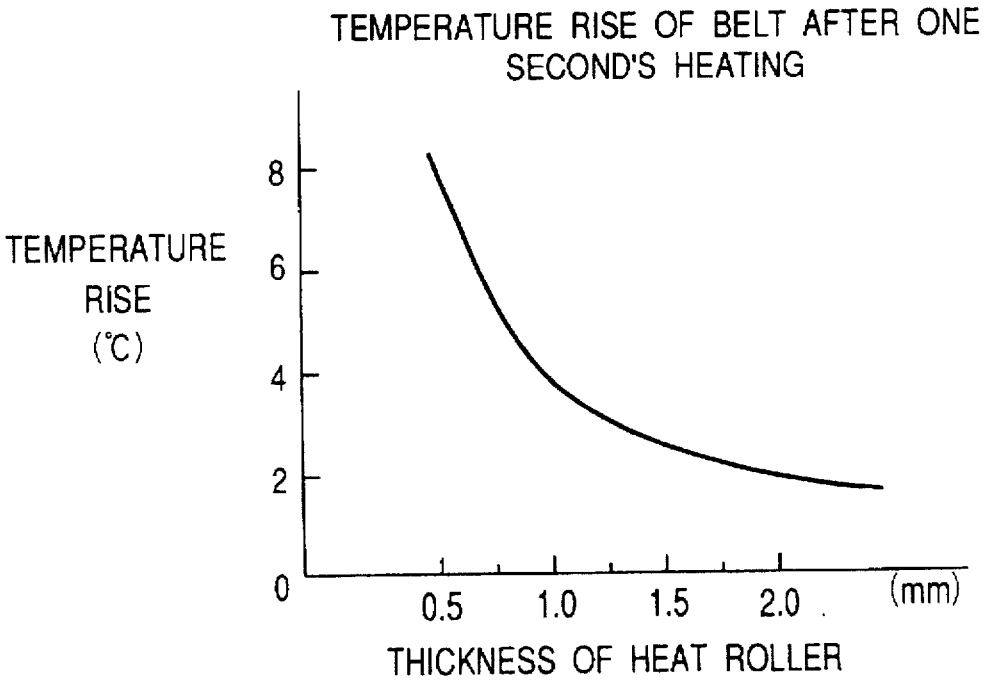
FIG. 11 is a graph which shows a relationship between a temperature rise of the fixing belt due to one second lighting of a heater lamp and the thickness of the heating roller.

FIG. 10 graphs the relationship between the overshooting temperature and the thickness of the heat roller while FIG. 11 graphs another relationship between the temperature rise of the fixing belt and a thickness of the heat roller. It is evident from above graphs that the heat roller having increased thickness has a greater heat capacity and therefore can reduce the overshooting temperature or temperature rise.

Figure 12:
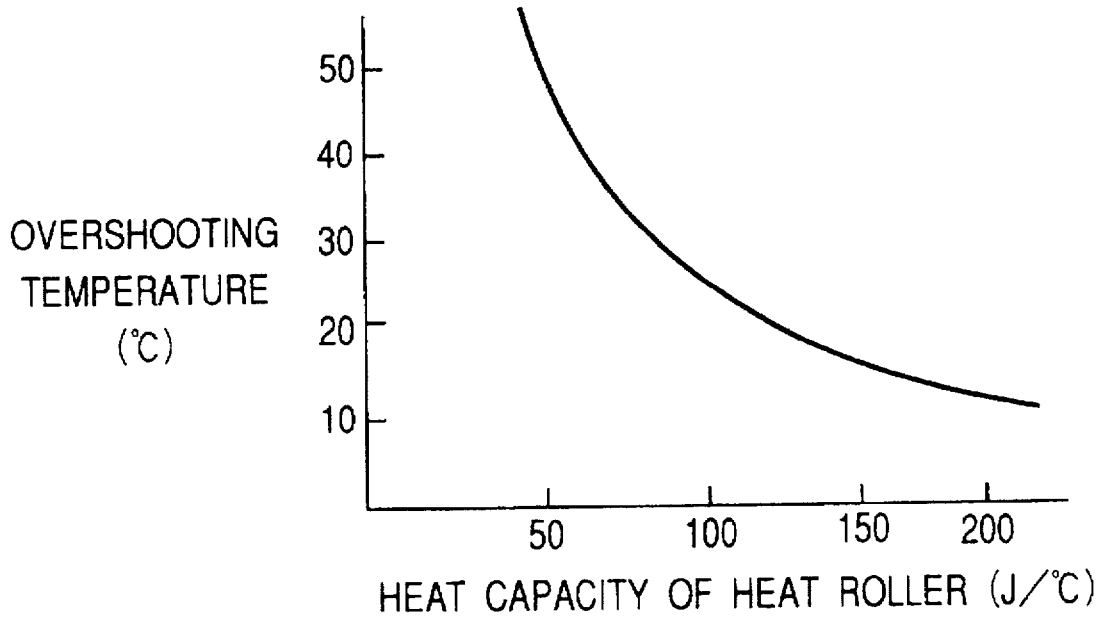
FIG. 12 is a graph which shows a relationship between the overshooting temperature of the fixing belt and a heat capacity of the heat roller.
Figure 13:
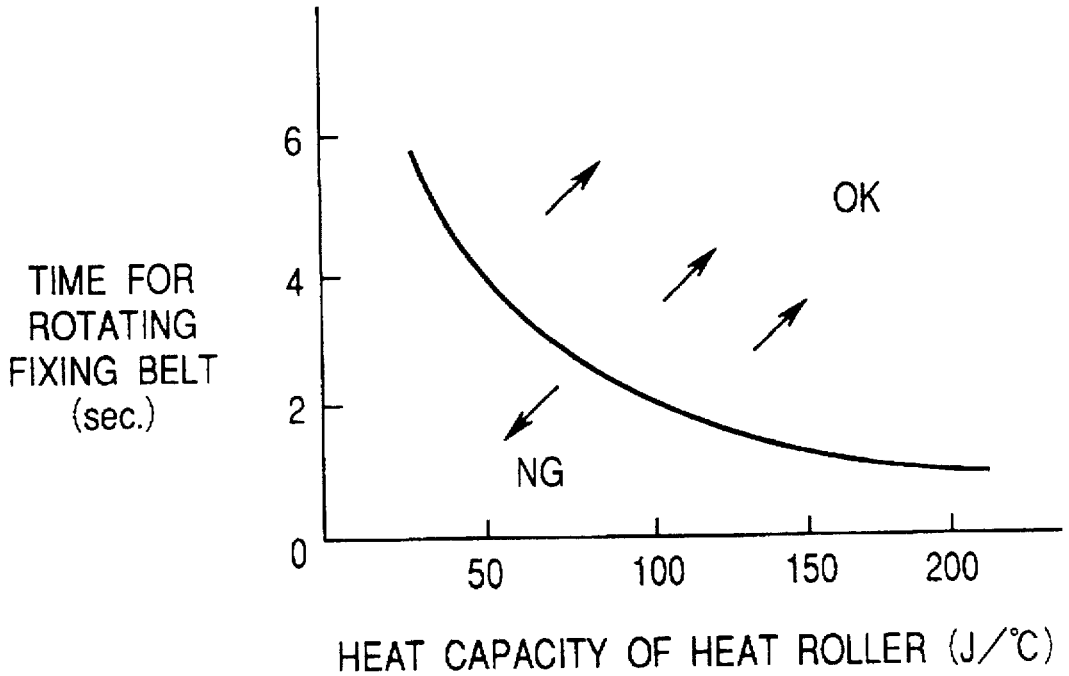
FIG. 13 is a graph which shows a relationship between the time of rotation of the fixing belt and the heat capacity of the heat roller.
Figure 14:
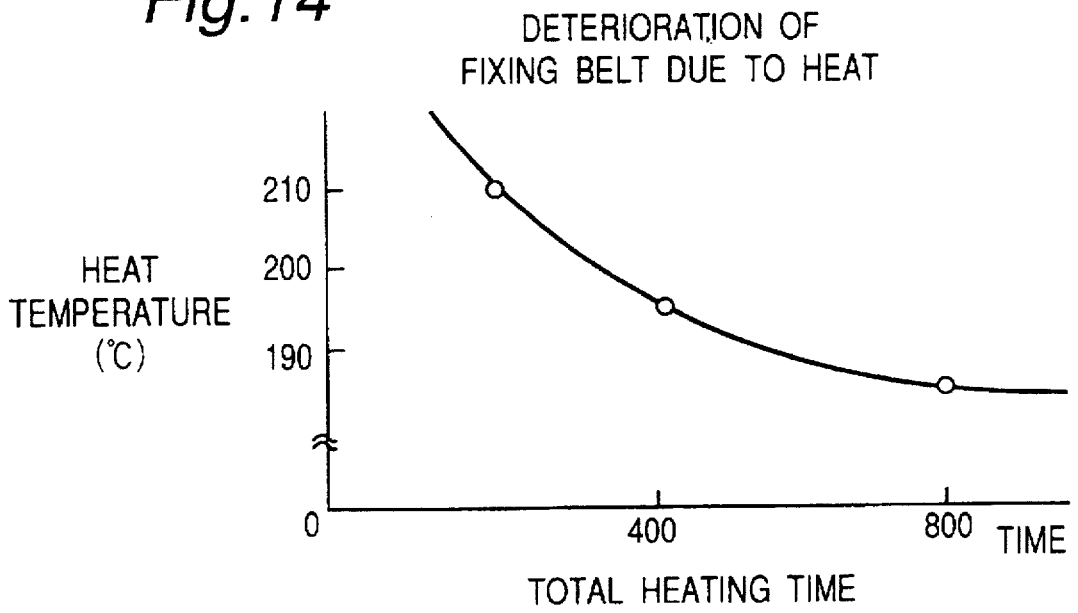
FIG. 14 is a graph showing that a deterioration of the fixing belt changes in accordance with the temperature and a total heating time.
Figure 15:
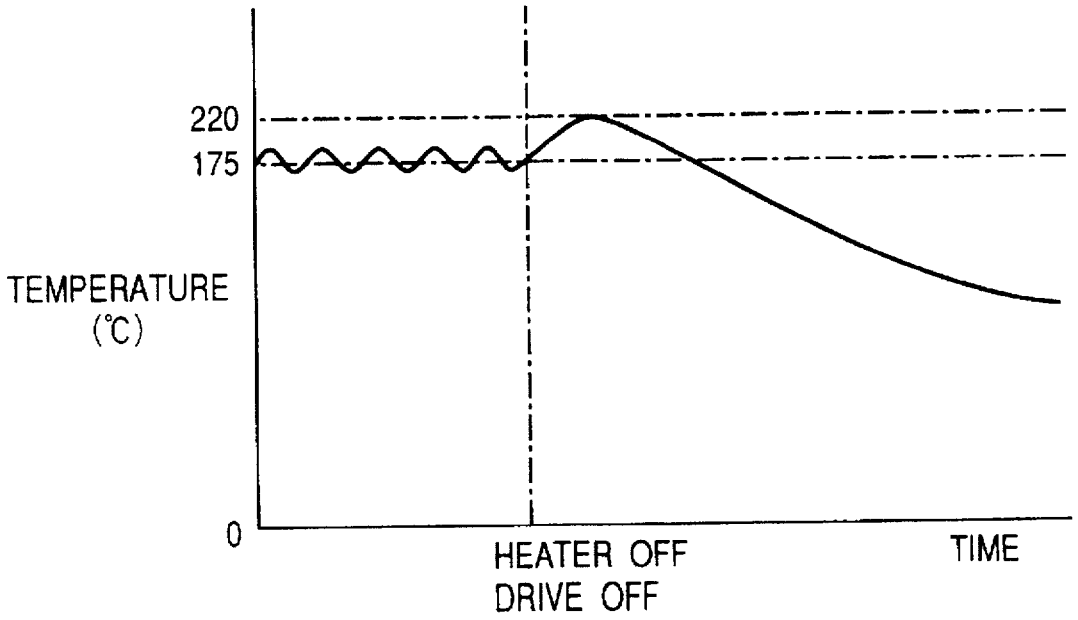
FIG. 15 is a graph which shows a temperature variation of the fixing belt in a case that both the heater and the belt is simultaneously switched off.

Further, FIG. 12 graphs the relationship between the overshooting temperature and the heat capacity of the heat roller while FIG. 13 graphs the relationship between the rotating time of the fixing belt for cooling it down to a predetermined temperature, e.g., about 165° C., and a heat capacity of the heat roller. From these graphs, it is evident that both the overshooting temperature and the rotating time of the fixing belt decreases as the heat capacity of the heat roller increases.

Furthermore, the inventors made experiments and came to a conclusion that overshooting can be eliminated by rotating the heat roller and the fixing belt after switching off the heat lamp for a period of time T3 seconds determined by the following equation:

$$T3=200/Hc$$

where Hc represents the heat capacity (Joule/ °C.) of the heat roller.

Although the present invention has been described in relation to particular embodiments thereof, many other variations and modifications and other uses will become apparent to those skilled in the art.

For example, although the heating means for heating the fixing belt is mounted in one of the roller supporting the fixing belt, it can be arranged outside the fixing belt. Also, the fixing means may be arranged in contact with or apart from the fixing belt.

What is claimed is:

1. A belt heating system, comprising:

an endless belt;

supporting means mounted inside said belt for rotatably supporting said belt;

drive means for rotating said belt;

heating means for heating said belt; and control means for controlling said drive means so that said belt halts a predetermined time period after said heating means has stopped heating said belt.

2. A belt heating system claimed in claim 1, wherein said predetermined time period is a time required for said fixing belt to make two revolutions.

3. A belt heating system which includes an endless belt rotatably entrained around a plurality of supporting means and a pressure means arranged in contact with an outer peripheral surface of said endless belt to form a nipping region therewith where a toner image supported on a sheet is nipped and transported and thereby fixed on said sheet, comprising:

drive means for rotating said belt;

heating means for heating said belt; and control means for controlling said drive means so that said belt halts a predetermined time period after said heating means has stopped heating said belt.

4. A belt heating system claimed in claim 3, wherein said predetermined time period is a time required for said belt to make two revolutions.

5. An image forming apparatus which includes a belt fixing system, said belt fixing system having an endless belt rotatably entrained around a plurality of supporting means and a pressure means arranged in contact with an outer peripheral surface of said endless belt to form a nipping region therewith where a toner image supported on a sheet is nipped and transported and thereby fixed on said sheet, comprising:

drive means for rotating said belt;

heating means for heating said belt; and control means for controlling said drive means so that said belt halts a predetermined time period after said heating means has stopped heating said belt.

6. An apparatus claimed in claim 5, wherein said predetermined time period is a time required for said belt to make two revolutions.

7. An apparatus claimed in claim 5, wherein said apparatus is capable of performing a single print mode for printing one sheet or a multiple print mode for continuously printing a plurality of sheets alternatively, and said control means changes said time period depending upon said print mode to be performed.

8. An apparatus claimed in claim 7, wherein said time period for multiple print mode is greater than that of single print mode.

9. A method for controlling a belt heating system in which an endless belt entrained around a plurality of supporting means is heated by a heating means and rotated by a drive means, comprising:

a first step for switching said heating means off; and a second step for halting said belt a predetermined time period after said first step.

10. The belt heating system according to claim 1, wherein the control means sends a halt signal to the drive means after sending a stop heating signal to the heating means.

11. The belt heating system according to claim 3, wherein the control means sends a halt signal to the drive means after sending a stop heating signal to the heating means.

12. The belt heating system according to claim 5, wherein the control means sends a halt signal to the drive means after sending a stop heating signal to the heating means.

13. The belt heating system according to claim 1, wherein the control means is for controlling said drive means so that said belt is not heated over a predetermined temperature after said heating means has stopped heating said belt.

14. The belt heating system according to claim 3, wherein the control means is for controlling said drive means so that said belt is not heated over a predetermined temperature after said heating means has stopped heating said belt.

15. The belt heating system according to claim 5, wherein the control means is for controlling said drive means so that said belt is not heated over a predetermined temperature after said heating means has stopped heating said belt.

* * * * *